US006564407B1

(12) United States Patent
Luu et al.

(10) Patent No.: US 6,564,407 B1
(45) Date of Patent: May 20, 2003

(54) TRAVEL PILLOW FOR ACCOMODATING THE THIGHS OF A SEATED USER

(76) Inventors: Tom Tho-Truong Luu, 232 Beegum Way, San Jose, CA (US) 95123; Ana Nicho Luu, 232 Beegum Way, San Jose, CA (US) 95123

( * ) Notice: Subject to any disclaimer, the term of this patent is extended or adjusted under 35 U.S.C. 154(b) by 0 days.

(21) Appl. No.: 10/072,072

(22) Filed: Feb. 9, 2002

(51) Int. Cl.[7] ..... A47G 9/00; A47C 20/02; A47C 27/08

(52) U.S. Cl. ..... 5/654; 5/653; 5/648; 297/219.1

(58) Field of Search ..... 5/653, 654, 648, 5/644; 297/467, 219.1

(56) References Cited

U.S. PATENT DOCUMENTS

| | | | | | |
|---|---|---|---|---|---|
| 2,942,281 | A | * | 6/1960 | Cole | 5/644 |
| 3,296,635 | A | * | 1/1967 | O'Hanlan | 297/219.1 |
| 4,712,833 | A | * | 12/1987 | Swanson | 297/219.1 |
| 4,910,818 | A | | 3/1990 | Grabill et al. | |
| 4,969,689 | A | * | 11/1990 | Kricheldorf | 297/467 |
| 5,216,771 | A | | 6/1993 | Hoff | |
| 5,317,773 | A | * | 6/1994 | Graebe | 5/653 |
| 5,418,991 | A | | 5/1995 | Shiflett | |
| 5,497,520 | A | | 3/1996 | Kunz et al. | |
| 5,522,106 | A | * | 6/1996 | Harrison et al. | 5/653 |
| D371,267 | S | * | 7/1996 | Ivy | 5/653 |
| 5,745,939 | A | | 5/1998 | Flick et al. | |
| 6,012,187 | A | | 1/2000 | Bushong et al. | |
| 6,175,979 | B1 | | 1/2001 | Jackson | |
| 6,182,314 | B1 | | 2/2001 | Frydman | |

FOREIGN PATENT DOCUMENTS

| | | | | |
|---|---|---|---|---|
| CH | 602056 | * | 7/1978 | 5/648 |

* cited by examiner

*Primary Examiner*—Alexander Grosz
(74) *Attorney, Agent, or Firm*—John A. Galbreath

(57) ABSTRACT

This invention is an inflatable or non-inflatable travel pillow that fits under the knees or lower thighs of the user, between those body areas and the cushion of a seat. The pillow elevates the user's lower thighs sufficiently to position the user's body back into the seat comfortably, and prevent the user from sliding down in the seat. A main body of the pillow has two thigh cradles located on its top surface. The thigh cradles are generally semicircular in shape, form depressions in the top surface of the main body, and are separated by a center rib formed by the proximate sides of the thigh cradles. In the inflatable embodiment, an air fill valve is located on the outer surface of the main body.

9 Claims, 3 Drawing Sheets

TRAVEL PILLOW FOR ACCOMODATING THE THIGHS OF A SEATED USER

CROSS-REFERENCES TO RELATED APPLICATIONS

Not applicable.

BACKGROUND

1. Field of the Invention

This invention is in the area of travel pillows, specifically an inflatable or non-inflatable travel pillow that fits under the knees or lower thighs of the user, between those body areas and the cushion off a seat. The pillow elevates the user's lower thighs sufficiently to position the user's body back into the seat comfortably.

2. Description of the Related Art

Various leg pillows are disclosed in the prior art, but none can be effectively used while the user is in a seated position.

U.S. Pat. Nos. 5,745,939 to Flick et al. and 6,012,187 to Bushong et al. disclose leg pillows for use only in a prone position. These pillows are positioned beneath a person's calves and feet while the user is lying down, and serve to support a person's lower legs while, for example, he or she is being turned in a hospital bed.

An inflatable orthopedic pillow which fits beneath a patient's lower leg is disclosed in U.S. Pat. No. 6,175,979 to Jackson, wherein the lower leg can be elevated to reduce swelling due to circulatory edema. In this device, the pillow suspends the heel and ankle of a patient's foot in mid-air. Like the foregoing devices, this device is also used by a patient lying in a supine position.

Leg pillows which fit between a user's thighs are shown in U.S. Pat. Nos. 5,216,771 to Hoff and 6,182,314 to Frydman. These pillows exhibit a generally "hourglass" shape for engaging the inner thighs of a user lying on his or her side while sleeping.

Leg pillows that fit under the knee are disclosed in U.S. Pat. Nos. 4,910,818 to Grabill et al., 5,418,991 to Shiflen, and 5,497,520 to Kunz et al. All three of these devices, however, are used by a patient in a supine, lying-down position, and all three also extend under the calf below the knee, in addition to extending under the knee itself and the thigh just above the knee. As such, these devices are neither capable of, nor suitable for, fitting beneath the lower thighs of a seated person.

Thus it can be seen that there is a great need for a travel pillow that fits beneath the user's knees and lower thighs, in order to elevate the lower thighs and position the user back comfortably in the seat of an airplane, train, bus, automobile, or other conveyance.

Accordingly, several objects and advantages of the invention are:

It elevates the lower thighs, thus positioning the user back firmly in his or her seat, so that the user does not tend to slide down in the seat, as usually happens.

It relieves pressure on the legs, allowing a long-distance traveler like an airline passenger on an overseas flight to remain comfortably in his or her seat for long periods of time.

In its inflatable embodiment, the pillow takes up a very small amount of space when stowed away, yet can be quickly and easily inflated to its full size and shape. The inflatable embodiment can also "adjust" to fit seats of different widths.

The height of main body 10, between the top and bottom surfaces at the sides, is greater than the length of the main body between the front and back surfaces. In addition, the width of main body 10 between the sides is significantly greater than the height of the main body between the top and bottom surfaces at the sides.

Further objects and advantages of the invention will become apparent from a consideration of the drawings and ensuing description.

SUMMARY

This invention is an inflatable or non-inflatable travel pillow that fits under the knees or lower thighs of the user, between those body areas and the cushion of a seat. The pillow elevates the user's lower thighs sufficiently to position the user's body back into the seat comfortably.

DETAILED DESCRIPTION OF THE INVENTION

Figure 1:
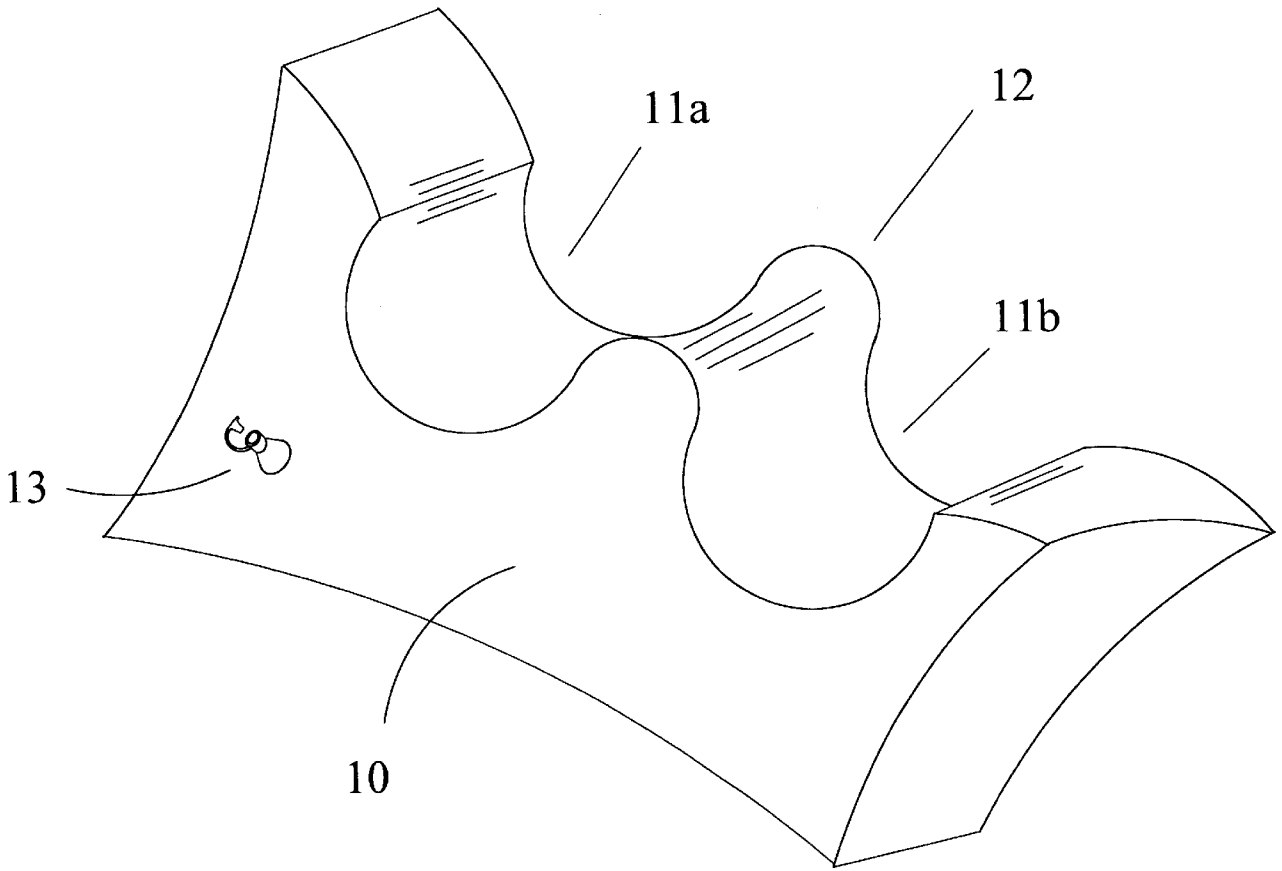
FIG. 1 is a perspective view of the pillow, showing the main body of the pillow and the two lower thigh-cradling openings located thereon.

The following provides a list of the reference characters used in the drawings:

| | |
|---|---|
| 10. | Main body |
| 11a & b. | Thigh cradles |
| 12. | Center rib |
| 13. | Air fill valve |
| 14a & b. | Knees |
| 15a & b. | Lower thighs |
| 16. | Seat cushion |
| 17a & b. | Seat sides/armrests |
| 18. | Seat back |
| 19. | Air fill tube (alternative embodiment) |

FIG. 1 is a perspective view of the invention. A main body 10 has two thigh cradles 11*a* & *b* located on its top surface. Thigh cradles 11*a* & *b* are generally semicircular in shape, form depressions in the top surface of main body 10, and are separated by a center rib 12 formed by the proximate sides of thigh cradles 11*a* & *b*. An air fill valve 13 is located on the outer surface of main body 10, and said air fill valve 13 can take several different forms known to one skilled in the art.

Figure 2:
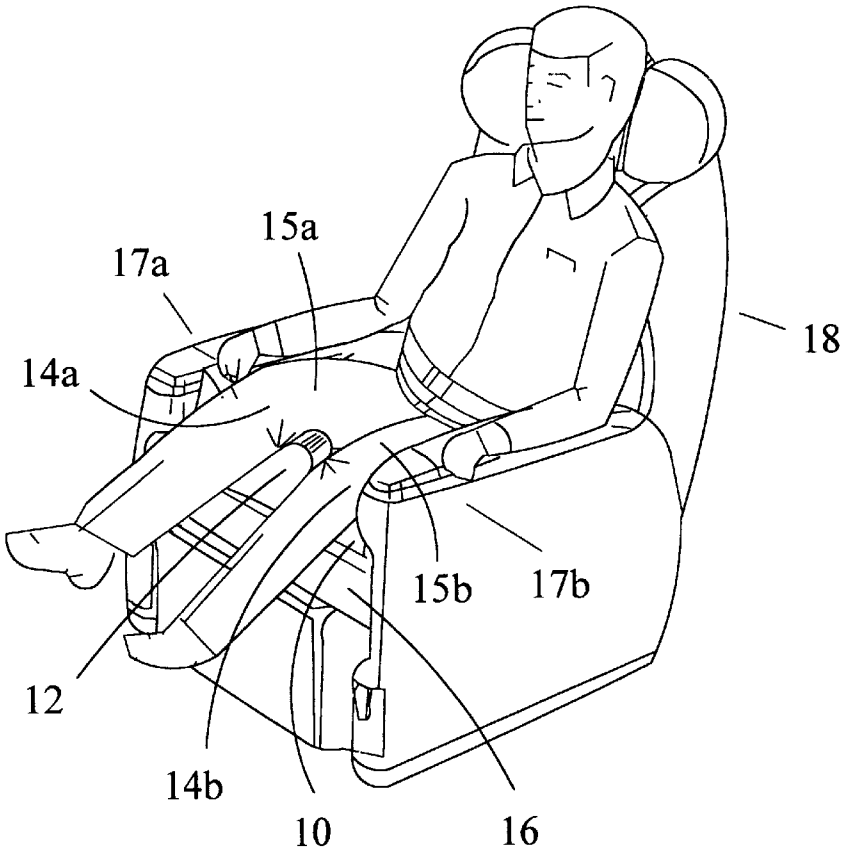
FIG. 2 illustrates the pillow in use, under the lower thighs of a seated person.

FIG. 2 demonstrates the use of the invention on a typical airline seat. The airline seat is comprised of a seat back 18, and seat cushion 16, and two seat sides/armrests 17*a* & *b*. A seated user places the pillow underneath his or her knees 14*a* & *b* and lower thighs 15*a* & *b*. After the pillow is thus positioned, the user's knees 14*a* & *b* and lower thighs 15*a* & *b* become elevated, thus pitching the user slightly back into the seat and preventing the user from sliding down in the seat while sleeping or relaxing.

Figure 3:
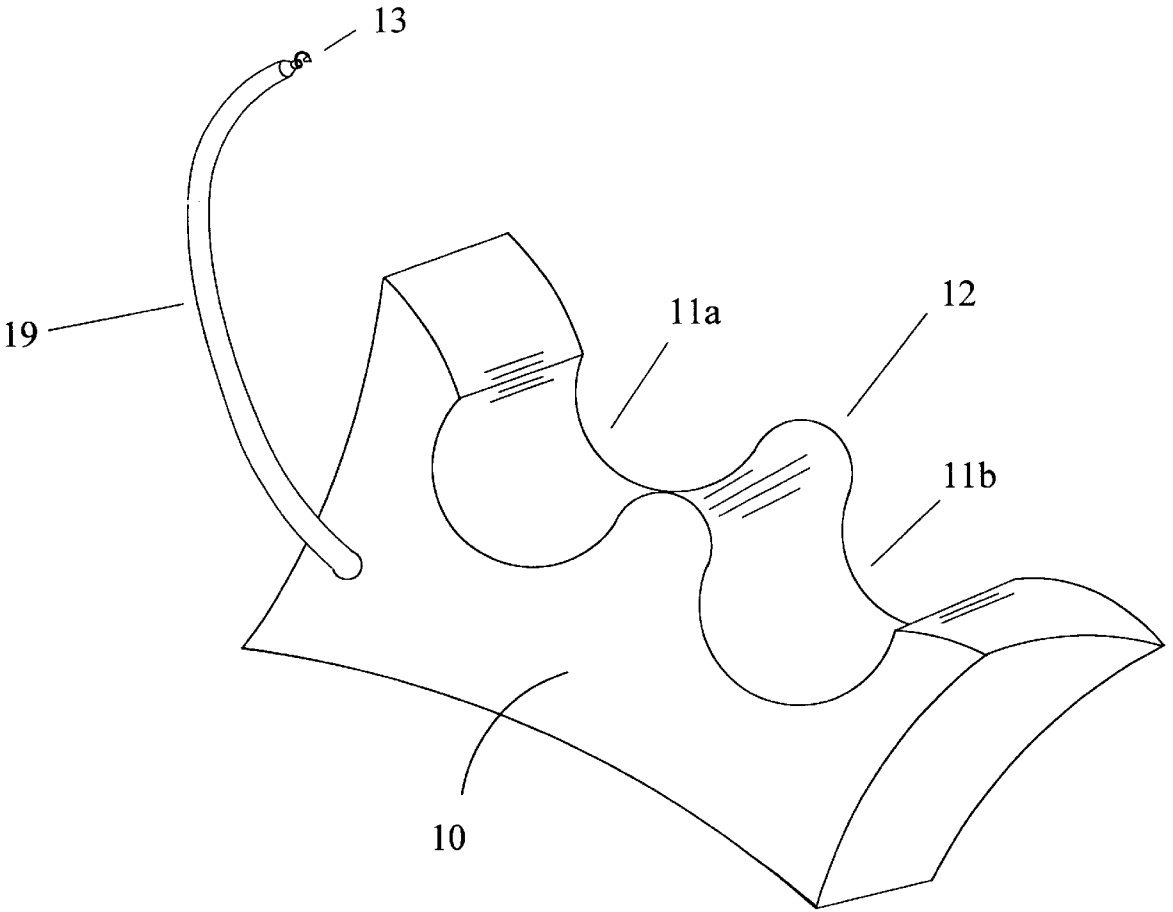
FIG. 3 is a perspective view of an alternative embodiment, with a flexible air fill tube attached to the main body.

FIG. 3 shows an alternative embodiment, wherein a flexible air fill tube 19 is attached to main body 10 at the point where air fill valve 13 is located in the main embodiment. Air fill valve 13 is relocated, in this alternative embodiment, to the free end of air fill tube 19. The flexible air fill tube 19 allows a user to position the unfilled pillow in place beneath his or her knees 14*a* & *b* and lower thighs 15*a* & *b*, and inflate the pillow "in placed". Alternatively, the user can easily adjust the inflation pressure to his or her liking after the pillow is already is place.

Conclusions, Ramifications, and Scope

Thus the reader will see that this invention provides a very effective way of increasing the comfort level of a person who must remain seated for a considerable length of time, such as an airline passenger on a long overseas flight.

While the above descriptions contain many specificities, these shall not be construed as limitations on the scope of the invention, but rather as exemplifications of embodiments thereof. Many other variations are possible. Examples of just a few of the possible variations follow:

The invention can be used on all manner of seats used in travel conveyances, including but not limited to airplanes, trains, buses, and automobiles. The invention can also be used on an ordinary "easy chair" or other suitable type of lounge chair, to relieve pressure on the legs and increase comfort. Thus, the invention, although referred to as a travel pillow, does not have to be used just for travel.

The invention can be embodied in both inflatable and non-inflatable versions.

The invention can be used on a chair without armrests or sides. Of course, a user's legs may shift transversely somewhat when the invention is used in an armless chair, but the basic functionality—the elevation of the user's knees and lower thighs—is maintained.

The size and shape of the pillow can vary—all that is required is that the pillow be suitably sized and shaped to fit beneath the user's knees and lower thighs and between the sides or armrests of the seat, if the seat has such sides or armrests.

The "height" of the pillow—that is, the extent to which the pillow elevates the knees and lower thighs—can vary. The "depth" of the pillow can also vary; however, it can be appreciated that as the depth of the pillow is increased, the pillow will extend under more and more of the thighs, altering the effective angle of elevation of the knees and lower thighs.

Accordingly, the scope of the invention should be determined not by the embodiments illustrated, but by the appended claims and their legal equivalents.

What is claimed is:

1. A pillow, comprising:

(c) a main body having top, bottom, front, and back surfaces, and two opposing sides, adapted for positioning between a lower thigh of a user and a seat cushion of a seating surface when said user is seated on said seating surface, said width of said main body between said sides being significantly greater than the height of said main body between said top and bottom surfaces at said sides, and said height of said main body, between said top and bottom surfaces at said sides, being greater than the length of said main body between said front and back surfaces, and (d) at least one depression located on said top surface of said pillow, suitable for cradling said lower thigh of said user, whereby said user's lower thigh is elevated from said seating surface, thus increasing said user's comfort.

2. The pillow of claim 1, wherein two depressions are located on said top surface of said pillow, suitable for cradling said lower thighs of said user.

3. The pillow of claim 2, wherein said pillow further comprises an upstanding center rib formed by the proximate sides of said two depressions.

4. The pillow of claim 3, wherein said pillow is inflatable and further comprises inflating means located on one of said surfaces of said pillow.

5. The pillow of claim 4, wherein said inflating means comprises an air fill valve.

6. The pillow of claim 4, wherein said inflating means comprises an air fill tube attached to said pillow and an air fill valve located at a free end of said air fill tube.

7. The pillow of claim 1, wherein said pillow is inflatable and further comprises inflating means located on one of said surfaces of said pillow.

8. The pillow of claim 7, wherein said inflating means comprises an air fill valve.

9. The pillow of claim 7, wherein said inflating means comprises an air fill tube attached to said pillow and an air fill valve located at a free end of said air fill tube.

* * * * *